US012453997B2

(12) United States Patent
McAtarsney et al.

(10) Patent No.: US 12,453,997 B2
(45) Date of Patent: Oct. 28, 2025

(54) REPAIR TOOL

(71) Applicants: Barry McAtarsney, Loughall (GB); Jonathan Vandenfontyne, Ieykaul (BE)

(72) Inventors: Barry McAtarsney, Loughall (GB); Jonathan Vandenfontyne, Ieykaul (BE)

( * ) Notice: Subject to any disclaimer, the term of this patent is extended or adjusted under 35 U.S.C. 154(b) by 0 days.

(21) Appl. No.: 18/291,698

(22) PCT Filed: Mar. 15, 2023

(86) PCT No.: PCT/EP2023/056597
§ 371 (c)(1),
(2) Date: Jan. 24, 2024

(87) PCT Pub. No.: WO2023/180137
PCT Pub. Date: Sep. 28, 2023

(65) Prior Publication Data

US 2024/0261836 A1 Aug. 8, 2024

(30) Foreign Application Priority Data

Mar. 24, 2022 (GB) ..... 2204136

(51) Int. Cl.
*B21D 1/06* (2006.01)
*B21D 1/12* (2006.01)

(52) U.S. Cl.
CPC *B21D 1/06* (2013.01); *B21D 1/12* (2013.01)

(58) Field of Classification Search
CPC ... B21D 1/06; B21D 1/12; B21D 1/10; B21D 1/14
(Continued)

(56) References Cited

U.S. PATENT DOCUMENTS 2,531,728 A * 11/1950 Gersh ..... B21D 1/12 72/390.6
2,949,144 A * 8/1960 Dredske ..... B21D 1/12 72/705
(Continued)

FOREIGN PATENT DOCUMENTS

CN 211637814 U 10/2020
CN 113020324 A 6/2021
(Continued)

OTHER PUBLICATIONS

CN 106944500A, Yang Jul. 2017.*
(Continued)

*Primary Examiner* — Edward T Tolan
(74) *Attorney, Agent, or Firm* — Vitale, Vickrey, Niro, Solon & Gasey LLP

(57) ABSTRACT

A repair tool 10 comprising: first and second support elements 11, 12, the first and second support elements 11, 12 each comprising a first end 13 which is engagable with a portion of material to be repaired and a second end 14 distal the first end. A spanning member 15 is engagable with the support elements 11, 12 at or about the second end 14 thereof, the spanning member being sized and dimensioned to span between said support elements 11, 12, in a spanning position above a portion of material to be repaired. The support elements 11, 12 are movable relative to the spanning member 15 in the longitudinal direction thereof to adjust the distance between the first and second support elements 11, 12. Thus, in use, when the first and second support elements 11, 12 are attached to a portion of material to be repaired, tension may be applied or released from said material by movement of one or both of the support elements 11, 12. The repair tool 10 further comprises one or both of the following features. The repair tool may firstly comprise a pull/push arrangement 16 mountable to the spanning member 15
(Continued)

between the first and second support elements 11, 12 and configured to apply a pulling force to a portion of the material to be repaired; and/or the spanning member 15 of the repair tool 10 is rotatable or otherwise movable laterally relative to at least a portion of the support elements 11, 12 such that the area between the support elements 11, 12 is more readily accessible.

19 Claims, 12 Drawing Sheets

(58) Field of Classification Search
USPC ..... 72/705
See application file for complete search history.

(56) References Cited

U.S. PATENT DOCUMENTS

| | | | | |
|---|---|---|---|---|
| 4,930,335 | A | 6/1990 | Ishihara | |
| 5,943,902 | A * | 8/1999 | Ishihara | B21D 1/12 72/705 |
| 6,964,186 | B1 | 11/2005 | Strasser | |
| 2005/0076700 | A1 | 4/2005 | Venalainen | |
| 2006/0016240 | A1 | 1/2006 | Uegaki | |

FOREIGN PATENT DOCUMENTS

| | | | | |
|---|---|---|---|---|
| CN | 113198875 | A | 8/2021 | |
| DE | 9315560 | U1 * | 1/1994 | B21D 1/06 |
| DE | 20022644 | U1 | 1/2002 | |
| EP | 0783926 | A1 | 7/1997 | |

OTHER PUBLICATIONS

CN 104475492A, Lin Apr. 2015.*
EP 1285704A1, Ritter Feb. 2003.*
CN 108202090A, Yao Jun. 2018.*
DE 19646101A1, Weismann May 1998.*
DE202012007287u1, Jung Sep. 2012.*
CN 113198875A, Jin et al. Aug. 2021.*
Search Report dated Oct. 13, 2022 in corresponding United Kingdom Application No. GB2204136.2.
International Search Report dated May 17, 2023 in corresponding PCT Application No. PCT/EP2023/056597.

* cited by examiner

REPAIR TOOL

This patent application is a 35 U.S.C 371 national stage application of International Patent Application No. PCT/EP2023/056597, filed on Mar. 15, 2023, which claims priority to United Kingdom Application No. 2204136.2, filed on Mar. 24, 2022. All of these disclosures are hereby expressly incorporated by reference as part of the present disclosure as if fully set forth herein.

FIELD OF THE INVENTION

This invention relates to a repair tool, and in particular to a repair tool for the repair of defects or damage in a material.

BACKGROUND OF THE INVENTION

Tools for the repair of material such as those utilised for the repair of vehicle body work are known. For example, it is known to provide a bridge like element that spans across a defect to be repaired, said bridge like element suspending a pulling means above the defect for applying a pulling force to the defect in order to repair the same. Whilst such solutions do allow the application of a pulling force, further apparatus such as ratchets and straps are required to apply further tension or compression forces which are useful when completing the repair, and in addition the bridge elements span directly above the repair site, making access to this site difficult such that it may be worked upon by further tools. As noted above, it is also known to apply a tension or compression force across a defect in a portion of material whilst carrying out a repair by attaching tabs by welding or by other means and using straps and ratchet mechanisms or the like to pull or push the tabs. However, applying even and consistent tension/compression using these methods can be difficult, and such arrangements are highly susceptible to the skill of the user in setting them up effectively in addition to being more time consuming to set up.

It is desirable to provide a repair tool that can apply a tension or compression force to material to be repaired whilst simultaneously improving access to the repair site and/or applying a pulling or pushing force to a defect.

SUMMARY OF THE INVENTION

According to the invention there is provided a repair tool comprising: at least first and second support elements, the first and second support elements each comprising a first end which is engagable with a portion of material to be repaired and a second end distal the first end; a spanning member engagable with the support elements, the spanning member being sized and dimensioned to span between said support elements in a spanning position above a portion of material to be repaired; wherein one or both of the support elements are movable relative to the spanning member in the longitudinal direction thereof when the support elements are attached to the material to be repaired to adjust the distance between the first and second support elements such that, in use, when the first and second support elements are attached to a portion of material to be repaired, a tension or compression force may be selectively applied or released from said material; and wherein the repair tool further comprises a pull/push arrangement mountable to the spanning member between the first and second support elements configured to apply a pulling or a pushing force to a portion of the material to be repaired; and/or wherein movable connection arrangements are provided between the spanning member and at least a portion of each support element such that the spanning member is rotatable laterally relative to at least a portion of the support elements, lateral being relative to the orientation of the spanning member, and to either side of the support elements, such that the area between the support elements is more readily accessible.

Advantageously, the repair tool may be attached to the material to be repaired at the first end of the support elements and at least one of the support elements may thereafter be moved along the spanning member, away from the other support element, to cause a tension force in the material. In addition, the same repair tool may also, or alternatively, provide the functionality to apply a pulling force on a defect in the material and/or provide the functionality to move the spanning member to provide improved access to the area to be repaired.

Further advantageously, the tension force applied by the movement of one or both of the support elements can remain applied even whilst the tool is used to provide a pulling force or a pushing force on a defect in the material and/or when the spanning member is moved to provide improved access to the area to be repaired.

Ideally, the support elements comprise foot portions at the first end thereof.

Preferably, the spanning member is engagable with the support elements at or about a second end thereof.

Preferably the foot portions are attachable to a portion of material to be repaired by adhesive or welding.

Preferably, one or both of the support elements are in slidable engagement with the spanning member such that said one or both support elements are slidable along said spanning member.

Ideally, the support elements comprise spanning member engagement means at the second end thereof.

Preferably, the spanning member engagement means of at least one of the first or second support member are movable engagement means for selectively effecting or permitting longitudinal movement of the support element relative to the spanning member.

Ideally, both the first and second support elements comprise movable engagement means for selectively effecting or permitting movement of the support element relative to the spanning member.

Preferably, the movable engagement means of the first support element comprises a releasable engagement means.

Ideally, the releasable engagement means may be released to allow free longitudinal movement of the first support element along the spanning member, and may be engaged to releasably fix the first support element to the spanning member at a desired position.

Preferably, the releasable engagement means of the first support element comprises first and second clamping surfaces which act to clamp the spanning member therebetween.

Ideally, the first clamping surface is provided by a clamping feature locatable on the opposing side of the spanning member from the first support element and the second clamping surface is provided by spanning member facing surface of the first support element.

Preferably, the first and second clamping surfaces are in operable engagement via a clamping actuation means such that said clamping surfaces are movable towards each other to clamp the spanning member therebetween and prevent movement of the first support member therealong, and moveable away from each other such that the first support element is freely movable along the spanning member.

Ideally, the clamping actuation means comprises a threaded clamping rod.

Preferably, the threaded clamping rod has a first end which extends through an aperture in the clamping feature.

Preferably, the spanning member has one or more void formed therein.

Ideally, the threaded clamping rod also extends through the void in the spanning member, and into a correspondingly threaded clamping rod receiving portion in the first support element.

Preferably, the threaded clamping rod is threadable into the clamping rod receiving portion.

Preferably, the threaded clamping rod is threadable into a correspondingly threaded throughbore formed in the clamping rod receiving portion.

Preferably, the threaded clamping rod has a clamping head located at its second end distal the first end thereof which is engagable with the clamping feature as the threaded clamping rod is threaded into the clamping rod receiving feature to apply a clamping force to the spanning member between the clamping feature and the first support element.

Ideally, the movable engagement means of the second support element comprises an adjustable engagement means.

Preferably, the adjustable engagement means comprises a user engagable control element operable to effect relative longitudinal movement between the spanning member and the second support element.

Ideally, the adjustable engagement means is a screw and thread type arrangement operable between the spanning member and second support element.

Preferably, the screw and thread type arrangement comprises a second support element threaded rod which extends in the longitudinal direction of the spanning member.

Ideally, the second support element threaded rod is mountable to the spanning member by one or more bushes or bearings or the like.

Preferably the second support element threaded rod is mountable to the spanning member by one or more bushes.

Preferably the second support element threaded rod is mountable to the spanning member by first and second bushes.

Ideally, the second support element threaded rod is mountable to the spanning member within the one or more void formed in the spanning member.

Preferably, the first and second bushes permit rotation of the threaded rod.

Ideally, the first and second bushes prevent any non-rotational movement of the threaded rod relative to the spanning member.

Preferably, the second support element threaded rod comprises a first end which is inserted through the first and second bushes.

Ideally, the second support element threaded rod has a second end opposing the first end, the second end having the user engagable control element.

Preferably, at least a portion of the second end of the second support element threaded rod extends from a longitudinal end of the spanning member.

Ideally, the user engagable control element is a knob attached to the second end of the second support element threaded rod such that rotation of the knob by a user rotates the second support element threaded rod.

Preferably, a locking pin is provided at the first end of the second support element threaded rod to prevent unintended removal of the second support element threaded rod from the first and second bushes by limiting longitudinal movement of the second support element threaded rod relative to the spanning member.

Ideally, the spanning member facing end of the second support element comprises a threaded rod receiving structure fixedly attachable thereto.

Preferably, the threaded rod receiving structure has a threaded throughbore corresponding to the thread of the second support element threaded rod.

Preferably, the second support element threaded rod is threadable through the threaded rod receiving structure and rotatable therewithin.

Ideally, as the second support element threaded rod is rotated within the bushes, the threaded rod receiving structure travels along the second support element threaded rod causing a corresponding movement of the second support element in the longitudinal direction of the spanning member.

Preferably, the spanning member is an elongate channel member.

Ideally, the spanning member comprises first and second outer walls defining an internal void.

Preferably, the spanning member comprises one or more engagement features formed for engagement with the support elements and/or the pull/push arrangement.

Ideally, engagement features of the spanning member comprise one or more upwardly depending flange extending from an upper side of the spanning member opposing the side in engagement with the support elements.

Ideally, engagement features of the spanning member comprise two upwardly depending flanges extending from an upper side of the spanning member opposing the side in engagement with the support elements.

Ideally, the one or more upwardly depending flanges extend in the longitudinal direction of the spanning member.

Preferably, the clamping feature of the movable engagement means of the first support element comprises one or more channels formed in the spanning member facing side thereof for receiving the one or more upwardly depending flanges of the spanning member such that movement of the clamping feature along the spanning member is guided by said one or more upwardly depending flanges.

Preferably, the engagement features of the spanning member comprise one or more downwardly depending flange extending from a lower side of the spanning member in engagement with the support elements.

Ideally, the one or more downwardly depending flanges extend in the longitudinal direction of the spanning member.

Preferably, the engagement features of the spanning member comprise two downwardly depending flanges extending from a lower side of the spanning member in engagement with the support elements.

Ideally, the engagement features of the spanning member comprise one or more inwardly depending flanges which extend from the first and second outer walls of the spanning member into the void thereof.

Preferably, the one or more inwardly depending flanges extend in the longitudinal direction of the spanning member.

Ideally, the engagement features of the spanning member comprise two inwardly depending flanges which extend from the first and second outer walls of the spanning member into the void thereof.

Preferably, the spanning member comprises first and second elongate channel sections joined in a spaced apart relationship.

Ideally the first and second channel sections are joined in a spaced apart relationship by spacing elements to define the void therebetween.

Preferably, a movable connection arrangement is provided which permits relative movement between the spanning member and at least a portion of the support elements.

Ideally, the movable connection arrangement is one or more hinged or other such rotatable arrangements such that the spanning member can be rotated laterally and the area between the support elements is more readily accessible.

Preferably, each of the support members comprises a hinged or other such rotatable arrangement, preferably proximal the first end thereof.

Ideally, the hinged or other such rotatable arrangements create a movable joint between two portions of the support elements.

Preferably, the support elements, or rotatable portion thereof, are of a length that when rotated the spanning member is moved laterally a distance which allows the repair site between the support elements to be worked on with further tools.

Preferably, the hinged or other such rotatable arrangements comprise hinge arrangements.

Ideally, the hinge arrangements are locatable proximal the foot of each support element such that the portion of each support element above the hinge arrangements is rotatable relative to the foot of the support elements.

Preferably, the hinged arrangements are configured to permit the portions of the support elements above said hinged arrangements to rotate approximately 90 degrees in each direction, said direction being the lateral relative to the orientation of the spanning member.

Ideally, the hinged arrangements are configured to permit the portions of the support elements above said hinged arrangements to rotate towards the material to be repaired to which the support elements are attached during use.

Preferably, the movable connection arrangement comprises one or more locking assembly for releasably locking the movable connection arrangement.

Ideally, locking of the one or more locking assembly prevents relative movement between the spanning member and at least a portion of the support elements about the movable connection arrangement, and release of the one or more locking assembly permits said relative movement.

Preferably, a locking assembly is provided for each hinged arrangement to prevent rotation of said hinge arrangements such that the spanning member can be locked in the spanning position, or in a rotated position wherein the spanning member is rotated to provide increased access to the portion of material to be worked on between the support elements.

Ideally, each support element comprises a locking assembly.

Preferably, the locking assemblies comprises a threaded locking element, the first end of which passes through an aperture in the second portion of a support element and into a threaded receiving element in the first portion of a support element.

Ideally, the receiving element comprises a complementary thread to that of the threaded locking element.

Preferably, the threaded locking element has a clamping surface provided on the second end thereof which interacts with a surface of the first portion of the support elements and applies a clamping force thereto.

Ideally, the clamping surface applies a clamping force as the threaded locking element is threaded into the receiving element Preferably, the clamping force applied by the clamping surface forces the first and second portions of the support elements together as the threaded locking element is threaded into the threaded receiving element.

Ideally, the clamping surface is provided by the lower surface of a locking knob which faces the foot of the support elements when attached to the second end of the threaded locking element.

Preferably, the locking knob may be turned to turn the threaded locking element, threading said threaded locking element into the threaded receiving element and thus applying the clamping force.

Ideally, the threaded locking element is a threaded rod.

Preferably, the pull/push arrangement comprises a pull/push assembly having a first end.

Ideally, the first end of the pull/push assembly is configured to be releasably attachable to the material to be repaired.

Preferably, the pull/push assembly comprises a second end operable by a user to cause a pulling force or a pushing force upon the material to be repaired.

Ideally, the pull/push arrangement further comprises a pull/push carriage.

Preferably, the pull/push carriage is configured for operable engagement with the spanning member such that the pull/push carriage is movable longitudinally along the spanning member.

Preferably, the pull/push carriage comprises one or more channels formed in the spanning member facing side thereof for receiving the one or more upwardly depending flanges of the spanning member such that movement of the pull/push carriage along the spanning member is guided by said one or more upwardly depending flanges.

Preferably, the pull/push carriage is configured to movably connect the pull/push assembly and the spanning member.

Ideally, the pull/push carriage comprises a protrusion feature.

Preferably, the protrusion feature interacts with a carriage rail feature of the spanning member to guide longitudinal movement along the spanning member and prevent vertical displacement of the pull/push carriage from the spanning member.

Preferably the carriage rail feature comprises two rail flanges of the spanning member which project laterally outwardly of the spanning member and the protrusion feature of the pull/push carriage abuts the underside of the carriage rail feature.

Preferably, the rail flanges extend longitudinally along the spanning member at or about each top longitudinal edge of the spanning member.

Ideally, the upwardly depending flanges of the spanning member extend from an upper surface of the carriage rail feature opposing the surface thereof which abuts the protrusion feature.

Ideally, the pull/push assembly comprises a material contact element which is contactable with the material to be repaired and optionally attached to said material, the material contact element being movable by the pull/push assembly towards or away from said material to be repaired such that a pulling or a pushing force may be selectably applied thereto.

Ideally, the material contact element is a pull/push member configured to apply a pulling or a pushing force to the material to be repaired.

Preferably, the pull/push member comprises a threaded pull/push member.

Ideally, the threaded pull/push member comprises a first end configured for attachment to material to be repaired, and a second end distal the first end.

Ideally, the pull/push assembly comprises a thread receiving portion attachable to the pull/push carriage.

Preferably, the threaded pull/push member extends from its first end beneath the spanning member, through the thread receiving portion in the pull/push carriage, and to its second end above the spanning member.

Preferably, threading of the threaded pull/push member into the thread receiving portion causes movement of the threaded pull/push member relative to the pull/push carriage and spanning member.

Ideally, rotation of the threaded pull/push member in a first direction causes the threaded pull/push member to move generally upwards such that the first end thereof moves away from the material to be repaired.

Ideally, rotation of the threaded pull/push member in a first direction causes the threaded pull/push member to move generally upwards such that the first end thereof moves towards the spanning member.

Advantageously, threading of the pull/push member in the first direction may apply a pulling force to material which may be attached to the first end of the pull/push assembly.

Ideally, rotation of the threaded pull/push member in a second direction causes the threaded pull/push member to move generally downwards such that the first end thereof moves away from the spanning member.

Advantageously, threading of the pull/push member in the second direction may apply a pushing force to material which may be attached to the first end of the pull/push assembly.

Preferably, rotation of the threaded pull/push member in a second direction opposing the first direction causes the threaded pull/push member to move generally downwards such that the first end thereof moves away from the spanning member.

Ideally, the threaded receiving portion is rotatably attachable to the pull/push carriage.

According to a second aspect of the invention there is provided a repair tool comprising: at least first and second support elements, the first and second support elements each comprising a first end which is engagable with a portion of material to be repaired and a second end distal the first end; a spanning member engagable with the support elements at or about the second end thereof, the spanning member being sized and dimensioned to span between said support elements in a spanning position above a portion of material to be repaired; wherein one or both of the support elements are movable relative to the spanning member in the longitudinal direction thereof to adjust the distance between the first and second support elements such that, in use, when the first and second support elements are attached to a portion of material to be repaired, tension may be selectively applied or released from said material; and wherein the repair tool further comprises a pull/push arrangement mountable to the spanning member between the first and second support elements configured to apply a pulling or a pushing force to a portion of the material to be repaired.

According to a third aspect of the invention there is provided a repair tool comprising: at least first and second support elements, the first and second support elements each comprising a first end which is engagable with a portion of material to be repaired and a second end distal the first end; a spanning member engagable with the support elements at or about the second end thereof, the spanning member being sized and dimensioned to span between said support elements in a spanning position above a portion of material to be repaired; wherein one or both of the support elements are movable relative to the spanning member in the longitudinal direction thereof to adjust the distance between the first and second support elements such that, in use, when the first and second support elements are attached to a portion of material to be repaired, tension may be selectively applied or released from said material; and wherein the spanning member is rotatable or otherwise movable laterally relative to at least a portion of the support elements such that the area between the support elements is more readily accessible.

BRIEF DESCRIPTION OF THE DRAWINGS

An embodiment of the invention is now described by way of example and with reference to the accompanying drawings in which.

DETAILED DESCRIPTION OF THE DRAWINGS

The present teaching will now be described with reference to an exemplary repair tool. It will be understood that the exemplary repair tool is provided to assist in an understanding of the present teaching and are not to be construed as limiting in any fashion. Furthermore, elements or components that are described with reference to any one Figure may be interchanged with those of other Figures or other equivalent elements without departing from the spirit of the present teaching.

Figure 1:
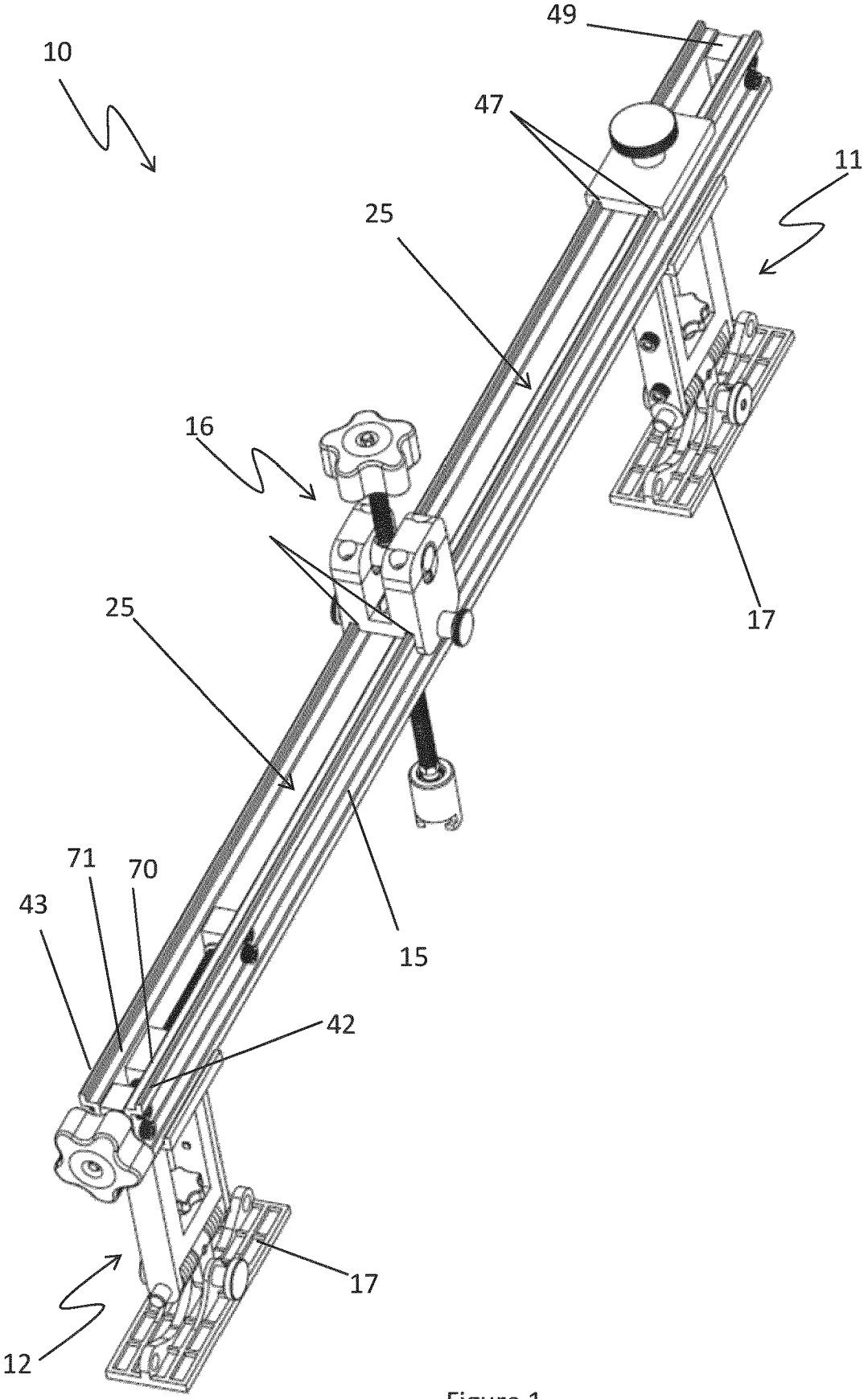
FIG. 1 is a an isometric view of a repair tool.
Figure 2:
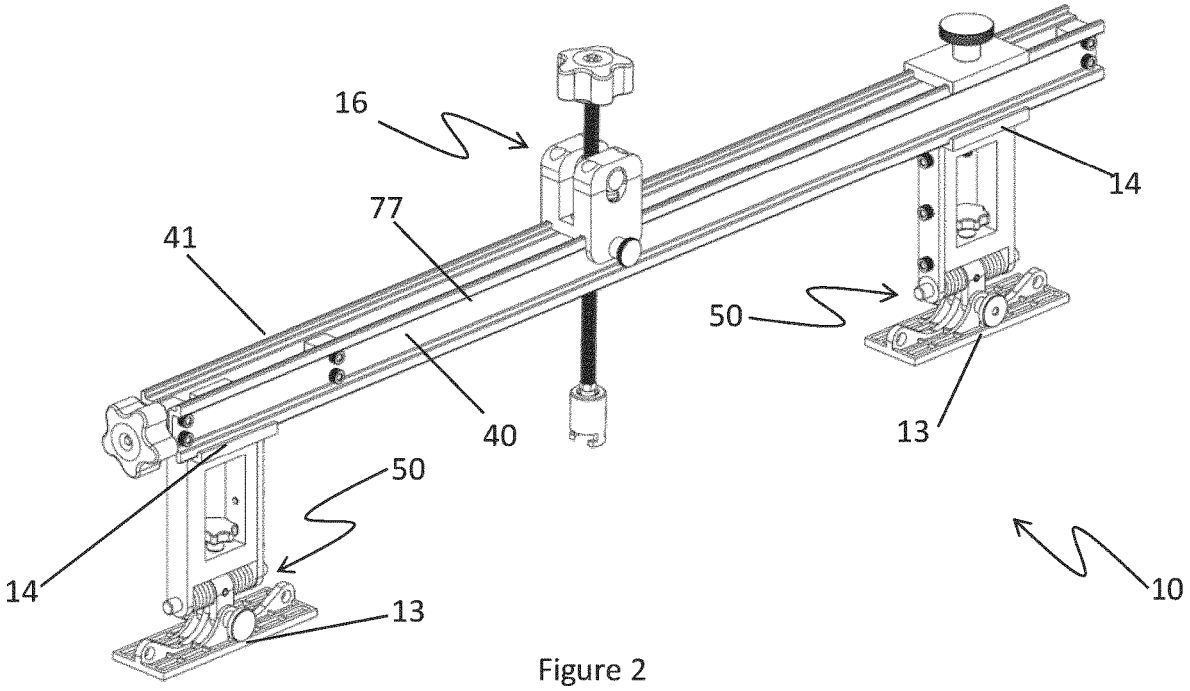
FIG. 2 is a further isometric view of the repair tool of FIG. 1.
Figure 3:
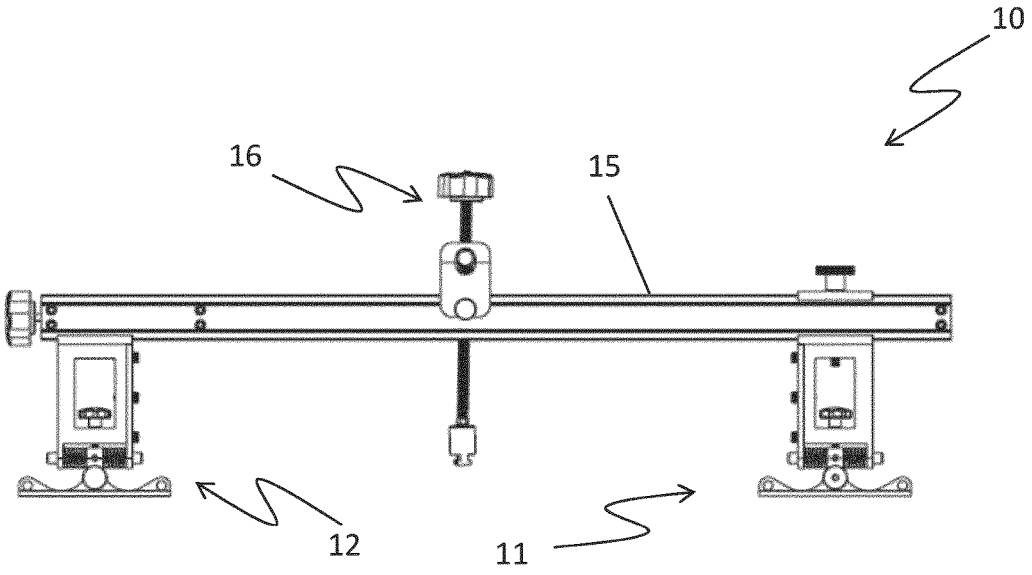
FIG. 3 is a right side view of the repair tool of FIG. 1.
Figure 4:
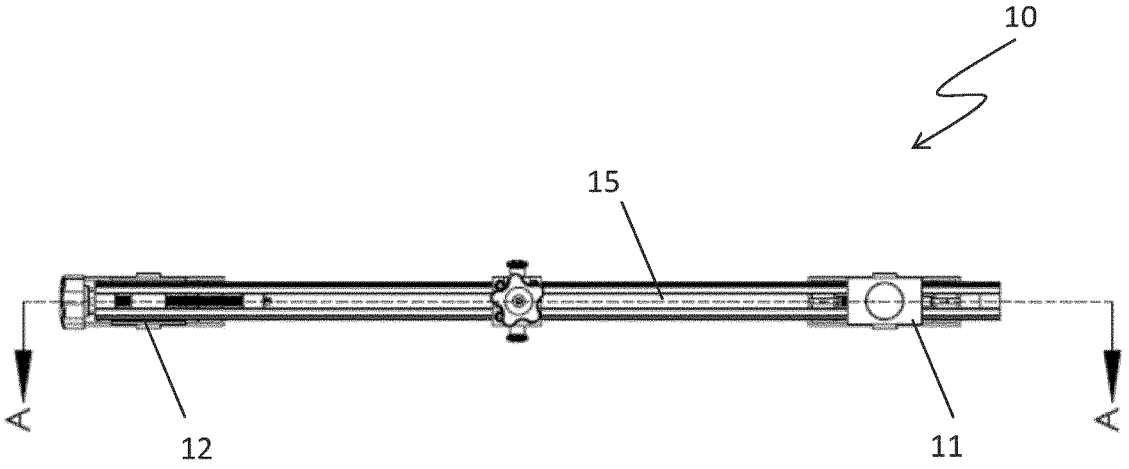
FIG. 4 is a top view of the repair tool of FIG. 1.
Figure 5:
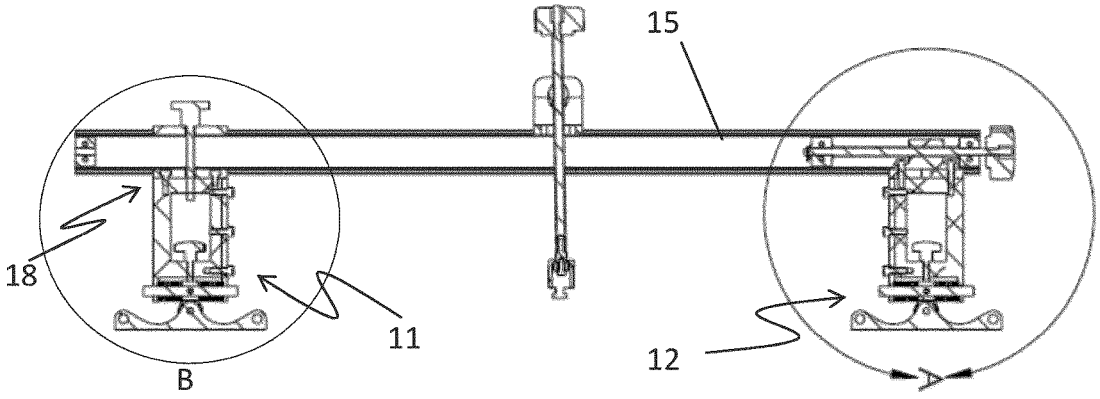
FIG. 5 is a cross sectional view of section AA of FIG. 4.

Referring now to the Figures there is illustrated a repair tool 10 comprising first and second support elements 11, 12. The first and second support elements each comprise a first end 13 which is engagable with a portion of material to be repaired and a second end 14 distal the first end 13. A spanning member 15 is engaged with the support elements 11, 12 at or about the second ends 14 thereof. The spanning member 15 is sized and dimensioned to span between said support elements 11, 12 in a spanning position above a portion of material to be repaired. This spanning position is best viewed in FIGS. 1 to 3, wherein the support elements 11, 12 extend vertically upwards to support the spanning member 15 directly above the area between the two support elements such that in a plan view, as shown in FIG. 4, the spanning member is located directly above the space occupied by the support elements 11, 12 and the space defined therebetween. Essentially, in the spanning position, the spanning member 15, supported by the support elements 11, 12, forms an elevated bridge directly above the site of repair. The support elements 11, 12 are movable relative to the spanning member 15 in the longitudinal direction of the spanning member 15. Thus movement of the support elements 11, 12 adjusts the distance between the first and second support elements 11, 12 such that, in use, when the first and second support elements 11, 12 are attached to a portion of material to be repaired, a tension or compression force may be applied to or released from said material. In other words, movement of one of the support elements in a direction away from the other support element causes a the moving support element to pull the portion of material to be repaired to which it is attached, the non-moving support element retaining the material to which it is attached in place. Thus a tension force is applied to the material to be repaired between the two support elements 11, 12. It should also be understood that movement of one or both of the first and second support elements 11, 12 towards each other acts to release the tension force, or the tool 10 may even be utilised to apply a compression force on the material between the first and second supports 11, 12 by further movement of said supports 11, 12 towards each other. The repair tool 10 further comprises one or both of the following additional features. The first additional feature is a pull/push arrangement 16 mountable to the spanning member 15 between the first and second support elements 11, 12. The pull/push arrangement 16 is configured to apply a pulling force, or alternatively a pushing force, to a portion of the material to be repaired. In this regards, references herein to a puling arrangement are for brevity only, said arrangement also being capable of applying a pushing force as will be hereinafter described. The second additional feature is that the spanning member 15 is rotatable or otherwise movable laterally relative to at least a portion of the support elements 11, 12 such that the area between the support elements 11, 12 is more readily accessible from above in order that a user may work on this area with other tools etc. Again, the repair tool of the present invention may comprise one or both of these additional features, but preferably both. However, it is highlighted that a tool comprising either of these additional features alone would be advantageous over the known prior art. The tool 10, in an embodiment comprising both additional features, facilitates application of a lateral force to the working surface of the material to be repaired, this force being a tension or a compression force depending on the direction of movement of the support elements 11, 12 relative to each other, with the spanning member 15 also having the pull/push arrangement 16 in operable engagement therewith to apply a pulling or a pushing force in unison with said tension or compression force. The lateral tension or compression force remains while rotating the spanning member 15 to provide open access to the damaged working surface.

The repair tool 10 is primarily intended for use in the repair of the bodywork of vehicles. The repair tool 10 may be attached to the material to be repaired (not shown) at the first end 13 of the support elements 11, 12 and one of the support elements 12 may thereafter be moved along the spanning member 15, away from the other support element, to cause a tension force in the material. The repair tool 10 may be attached to the material to be repaired (not shown) at the first end 13 of the support elements 11, 12 on either side of a defect such as a dent or the like to be repaired. In addition, the same repair tool 10 may also provide the functionality to apply a pulling force on a defect in the material and/or provide the functionality to move the spanning member 15 to provide improved access to the area to be repaired. Further advantageously, the tension force applied by the movement of one of the support elements 12 can remain applied even whilst the tool 10 is used to provide a pulling force on a defect in the material and/or when the spanning member 15 is moved to provide improved access to the area to be repaired. In the embodiment shown in the drawings the repair tool is for use on metallic body work of vehicles or the like; however it should be appreciated that the tool could be equally as useful in other repair scenarios or with other materials either in the same form or with slight modifications which would be evident to the skilled person.

The support elements comprise foot portions 17 at the first end thereof which are attachable to a portion of material to be repaired by adhesive, welding, or other such reasonable means. The skilled person would be aware of the various methods that can be utilised to temporarily attach repair tools to repair sites. The support elements comprise spanning member engagements 18, 19 at the second ends 14 thereof. The spanning member engagement 18, 19 of at least one of the first or second support member 11, 12 is a movable engagement 19 for selectively effecting or permitting longitudinal movement of the support element 12 relative to the spanning member 15. In the embodiment of the drawings the second support element 12 comprises the movable engagement 19. In the preferred embodiment, as shown in the drawings, both the first and second support elements 11, 12 comprise movable engagement 18, 19 for selectively effecting or permitting movement of the support elements 11, 12 relative to the spanning member 15. However, as will be described below, these movable engagements 18, 19 do not necessarily take the same form or permit relative movement in the same manner.

Figure 21:
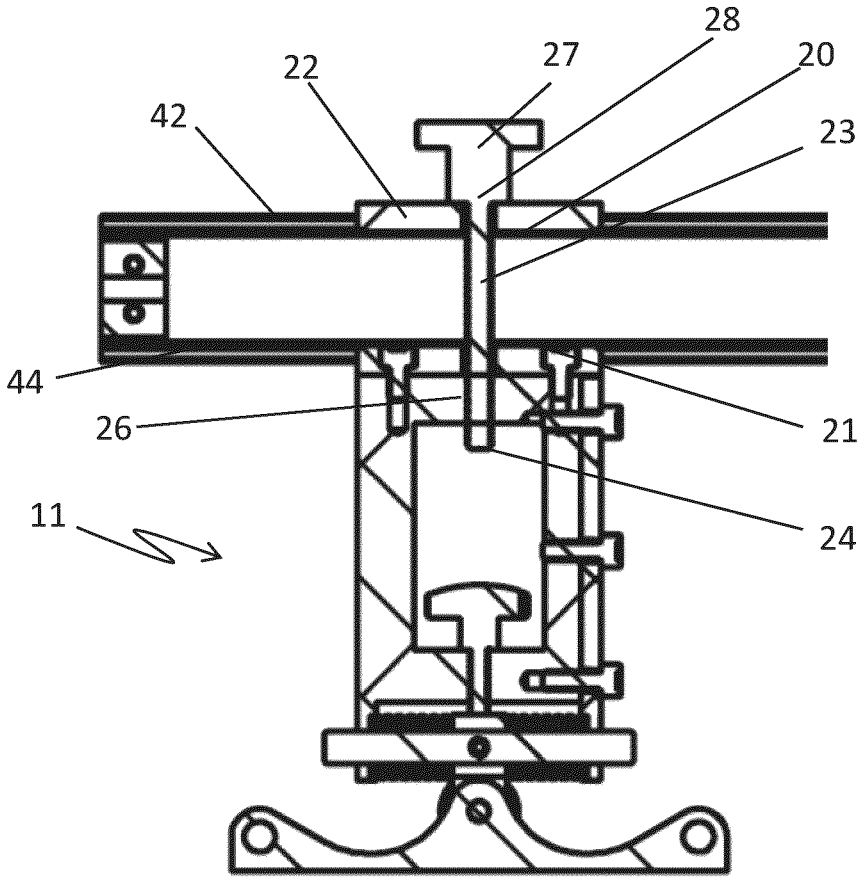
FIG. 21 is a detail cross sectional view of detail B of FIG. 5.

The movable engagement 18 of the first support element 11 comprises a releasable engagement assembly 18. The releasable engagement assembly 18 may be released to allow free longitudinal movement of the first support element 11 along the spanning member 15, and may be engaged to releasably fix the first support element 11 to the spanning member 15 at a desired position. This permits the repair tool 10 to be set such that the space between the first and second support elements 11, 12 is suitable for the repair in question. For example, in the case of smaller repairs the support elements 11, 12 will be placed closer together before attachment to the material to be repaired, for larger repairs the support elements 11, 12 may be placed further apart. As is best seen in FIG. 21, the releasable engagement assembly 18 of the first support element 11 comprises first and second clamping surfaces 20, 21 which act to clamp the spanning member 15 therebetween. The first clamping surface 20 is provided by a clamping feature 22 locatable on the opposing side of the spanning member 15 from the first support element 11 and the second clamping surface 21 is provided by a spanning member facing surface 21 of the first support element 11. In the embodiment of the drawings, the clamping feature is a plate like feature locatable on the top of the spanning member 15. The first and second clamping surfaces 20, 21 are in operable engagement via a clamping actuation assembly such that said clamping surfaces 20, 21 are movable towards each other to clamp the spanning member 15 therebetween and prevent movement of the first support member 11 therealong. The clamping actuation assembly is also actuatable such that the clamping surfaces 20, 21 are moveable away from each other such that the first support element 11 is freely movable along the spanning member 15. The clamping actuation assembly comprises a threaded clamping rod 23 having a first end 24 which extends through an aperture in the clamping feature 22, through a void section 25 in the spanning member 15, and into a correspondingly threaded clamping rod receiving portion 26 in the first support element 11, which comprises a correspondingly threaded throughbore for receiving the threaded clamping rod. The threaded clamping rod 23 is therefore threadable into the clamping rod receiving portion 24. The threaded clamping rod has a clamping head or knob 27 located at its second end distal 28 the first end 24 thereof which is engagable with the clamping feature 22 as the threaded clamping rod is threaded into the clamping rod receiving feature 26 to apply a clamping force to the spanning member 15 located between the clamping feature 22 and the first support element 11. It should be understood that any reasonable means for effecting movement may be utilised in place of the knob 27, this equally applies to other mentions of such knob features herein. Essentially, the releasable engagement assembly 18 forms a threaded clamping arrangement as is typical in this field. The drawings and description above provide only one example of how such a threaded clamping arrangement may be implemented, however this is not intended to be limiting as the skilled person would be well aware of many ways in which such an arrangement to selectively allow or prevent longitudinal sliding of one component along another could be implemented.

Figure 6:
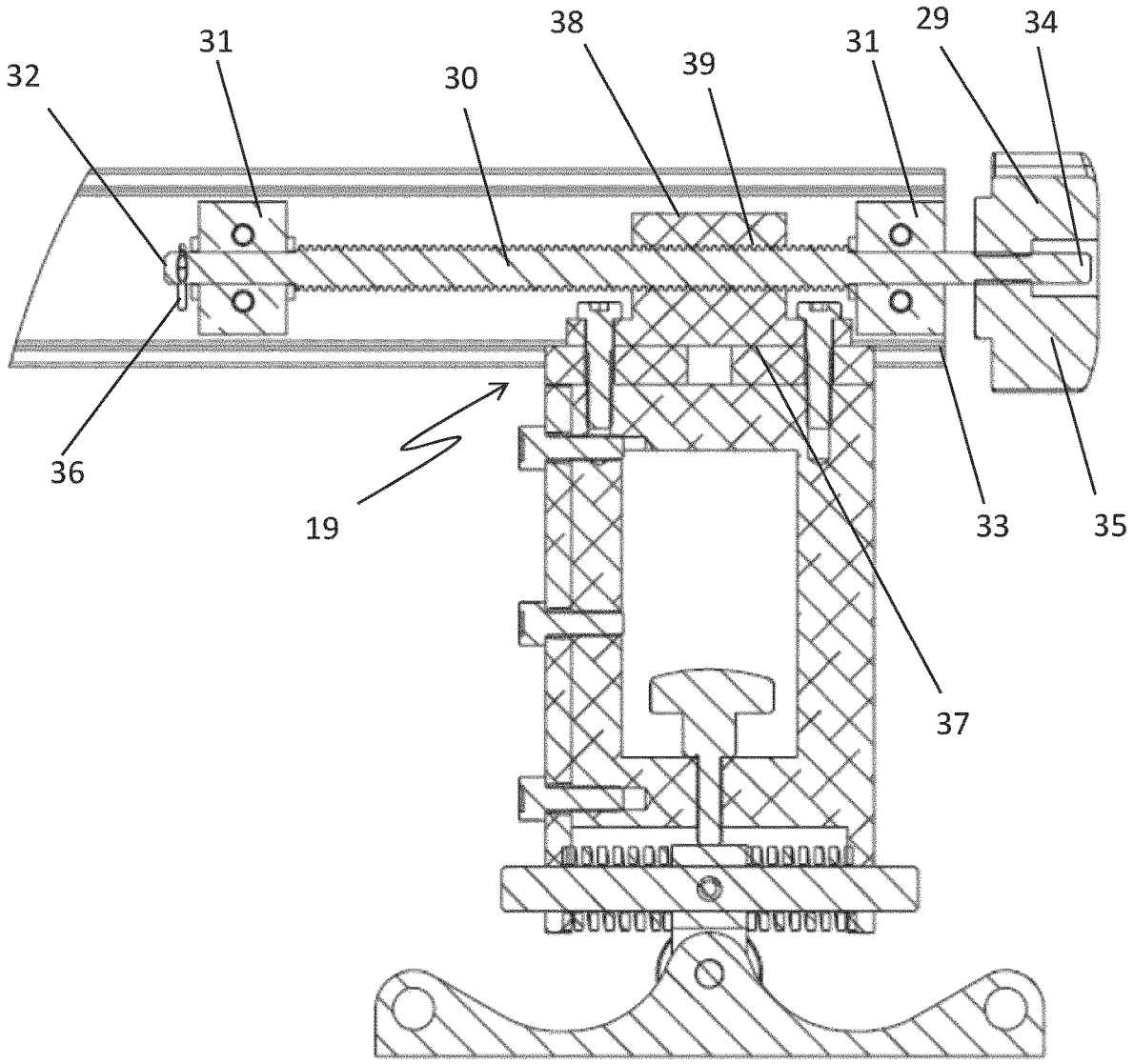
FIG. 6 is a detail cross sectional view of detail A of FIG. 5.
Figure 7:
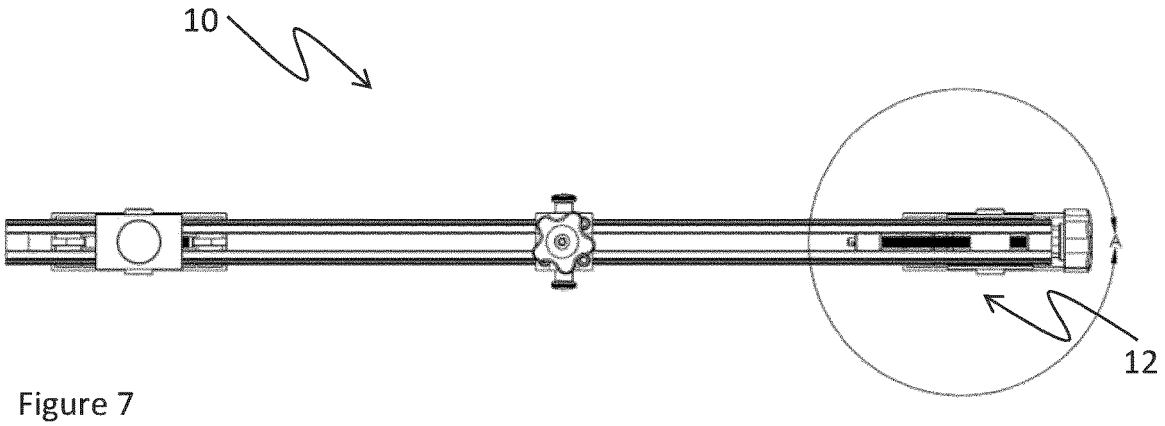
FIG. 7 is a further top view of the repair tool of FIG. 1.
Figure 8:
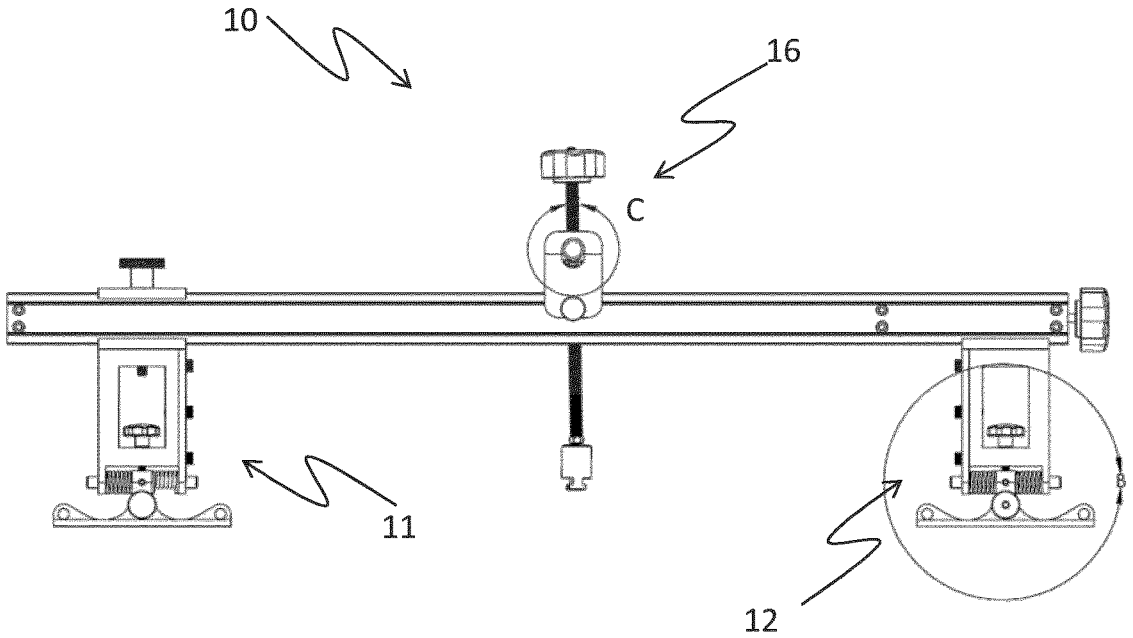
FIG. 8 is a left side view of the repair tool of FIG. 1.
Figure 9:
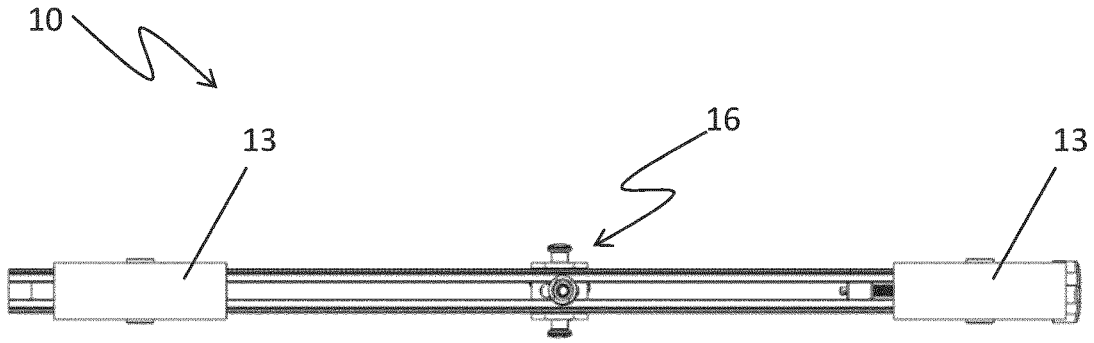
FIG. 9 is a bottom view of the repair tool of FIG. 1.
Figure 10:
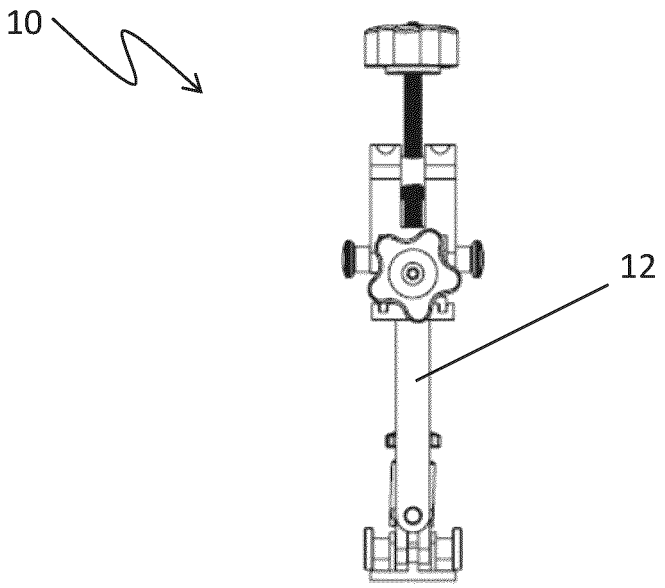
FIG. 10 is an end of the repair tool of FIG. 1 showing a spanning member thereof in a spanning position.
Figure 11:
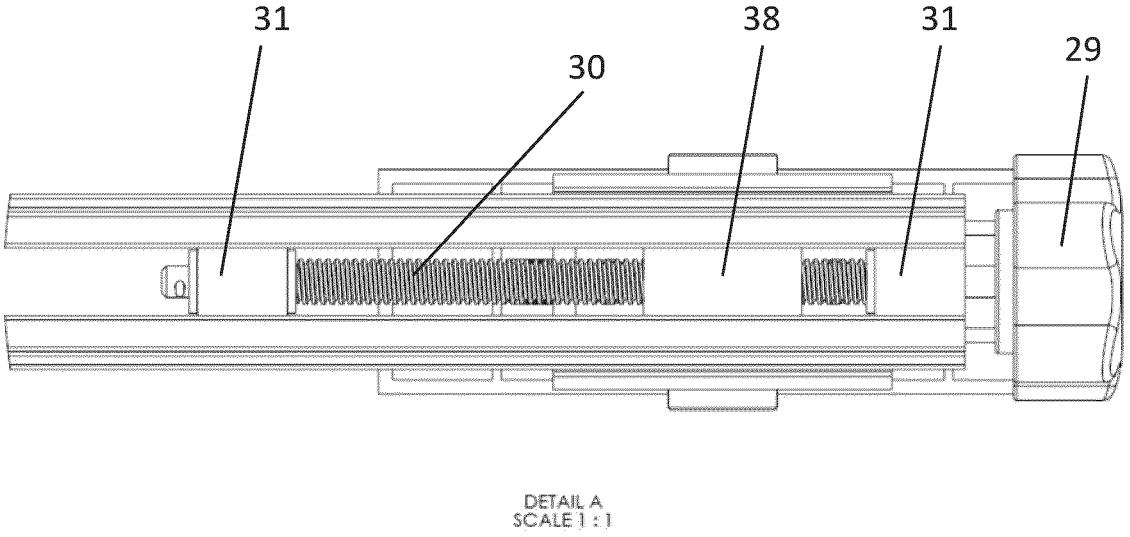
FIG. 11 is a detail view of detail A of FIG. 7.

The movable engagement 19 of the second support element comprises an adjustable engagement assembly 19. This is best viewed in FIG. 6. The adjustable engagement assembly 19 comprises a user engagable knob 29 operable to effect relative longitudinal movement between the spanning member 15 and the second support element 11. The adjustable engagement assembly 19 is a screw and thread type arrangement 19 operable between the spanning member 15 and second support element 12. The screw and thread type arrangement 19 comprises a second support element threaded rod 30 which extends in the longitudinal direction of the spanning member 15. The second support element threaded rod 30 is mountable to the spanning member 15 by first and second bushes 31. The second support element threaded rod 30, and the associated bushes 31, are mountable to the spanning member 15 within the one or more void 25 formed in the spanning member. The first and second bushes 31 permit rotation of the threaded rod 30 but prevent any non-rotational movement of the threaded rod 30 relative to the spanning member 15. The second support element threaded rod 30 comprises a first end 32 which is inserted through the first and second bushes 31 from the longitudinal end 33 of the spanning member 15. The second support element threaded rod 30 has a second end 34 opposing the first end 32, the second end 34 having the user engagable knob 35. A portion of the second end of the second support element threaded rod 30 extends from a longitudinal end 33 of the spanning member 15. Rotation of the user engagable knob 35 by a user rotates the second support element threaded rod 30 within the bushes 31. A locking pin 36 is provided at the first end 32 of the second support element threaded rod 30 to prevent unintended removal of the second support element threaded rod 30 from the first and second bushes 31 by limiting longitudinal movement of the first end 32 of the threaded rod 30 through the bush 31. The spanning member facing end 37 of the second support element 12 comprises a threaded rod receiving structure 38 fixedly attachable thereto. The threaded rod receiving structure 38 has a threaded throughbore 39 which has a thread corresponding to the thread of the second support element threaded rod 30. The second support element threaded rod 30 is threadable through the threaded rod receiving structure 38 such that it is threadably rotatable therewithin. As the second support element threaded rod 30 is rotated within the bushes 31, the threaded rod receiving structure 38 travels along the second support element threaded rod 30 causing a corresponding movement of the second support element 11 in the longitudinal direction of the spanning member 15. Where the repair tool 10 is attached to material to be repaired by the two support elements 11, 12, and the threaded rod 30 is rotated in a direction which moves the second support element 12 towards the longitudinal end 33 of the spanning member 15, the spreading of the support elements 11, 12 will apply a tension force to the material. In addition, as the second support element threaded rod 30 is not free to thread itself in the opposing direction with the thread of the threaded rod receiving structure 38, once it has been rotated to cause the desired level of tension it may be released and said tension will remain. The support elements 11, 12 provide a preloaded lateral force from the spanning member 15. The preloaded force is applied to the foot 17 of the support elements 11, 12 to provide a semi-constant lateral force over a greater displacement distance as the damaged material area pulls out. The embodiments of the drawings show a compression spring but this could also be achieved using a spring steel support member or other logical methods which would be well within the knowledge of the skilled person.

Again, as with the movement assembly of the first support element 11, the assembly to effect movement of the second support element 12 is provided as one example of how such movement could be implemented. However, the skilled person would be aware of various mechanisms and assemblies that could give rise to the required movement all of which should be considered to fall within the scope of the attached claims. Movement of the first and/or second support elements could for example be implemented by utilising a pneumatic or hydraulic arrangement, which would be well known to the skilled person.

It should be understood that the embodiment of the drawings is only one possible implementation wherein a first support element 11 is movable to set an approximate support element spacing suitable for the repair in question, and once the repair tool is attached to the repair site the second support element is moved to apply a tension force. This is not intended to be limiting, the skilled person would understand that, for example, a simplified version of the tool could be manufactured wherein the first support element is not movable and the only movement is via the second support element. Further, one of the support elements could comprise both the releasable engagement assembly and the adjustable movement assembly such that said one support element could initially be moved to a suitable support element spacing, the tool could be attached to the repair site, and the same support element could them be moved to apply the tension force. It would be well within the knowledge of the skilled person to adapt the disclosure herein to manufacture such and other variants of the design and such variants are intended to fall within the scope of protection afforded by the attached claims. It should also be understood that the invention as shown in the drawings comprises first and second support elements 11, 12 only, however any number of support elements may be utilised within the scope of the invention, providing the ability to work upon multiple areas of damage or simply to provide greater support to the spanning member 15. Therefore, the scope of protection would be construed by the skilled person to encompass any number of support elements equal or greater than two.

Preferably, the spanning member 15 is an elongate channel member 16 comprising first and second outer walls 40, 41 defining an internal void 25. In the embodiment of the drawings the spanning member 15 comprises one or more engagement features 42, 43, 44, 45, 46 formed for engagement with the support elements 11, 12 and/or the pull/push arrangement 16. The engagement features of the spanning member 15 comprise two upwardly depending flanges 42, 43 extending from an upper side of the spanning member 15 opposing the side in engagement with the support elements 11, 12. The upwardly depending flanges 42, 43 extend in the longitudinal direction of the spanning member 15. The clamping feature 22 of the movable engagement assembly 18 of the first support element 11 comprises channels 47 formed in the spanning member facing side thereof for receiving the upwardly depending flanges 42, 43 of the spanning member 15 such that movement of the clamping feature 22 along the spanning member 15 is guided by the upwardly depending flanges 42, 43.

The engagement features of the spanning member also comprise two downwardly depending flanges 44, 45 extending from a lower side of the spanning member 15 in engagement with the support elements 11, 12. The downwardly depending flanges 44, 45 extend in the longitudinal direction of the spanning member 15. The support elements 11, 12 comprise upstanding abutment features 48 which are spaced apart laterally on the top of the support elements 11, 12 such that the spanning member 15 may be seated between the abutment features 48 and the downwardly depending flanges 44, 45 of the spanning member abuts the abutment features 48. Resultantly, the abutment between the downwardly depending flanges 44, 45 and the abutment features 48 guides movement of the support elements 11, 12 along the spanning member 15 and prevents unintended lateral movement thereof.

The engagement features of the spanning member 15 also comprise two inwardly depending flanges 46 which extend from the first and second outer walls 40, 41 of the spanning member into the void 25 thereof. The two inwardly depending flanges 46 extend in the longitudinal direction of the spanning member 15.

In the embodiment of the drawings, the spanning member 15 comprises first and second elongate channel sections 40, 41, which define the outer walls 40, 41 thereof. The channel sections 40, 41 are joined in a spaced apart relationship by spacing elements 49 to define the voids 25 therebetween. In the embodiment of the drawings, the bushes of 31 may also act as spacing elements. It should be noted that whilst the spanning member 15 is shown in the drawings a comprising multiple portions joined to form the final structure; the spanning member 15 could equally be formed as a single part.

Figure 12:
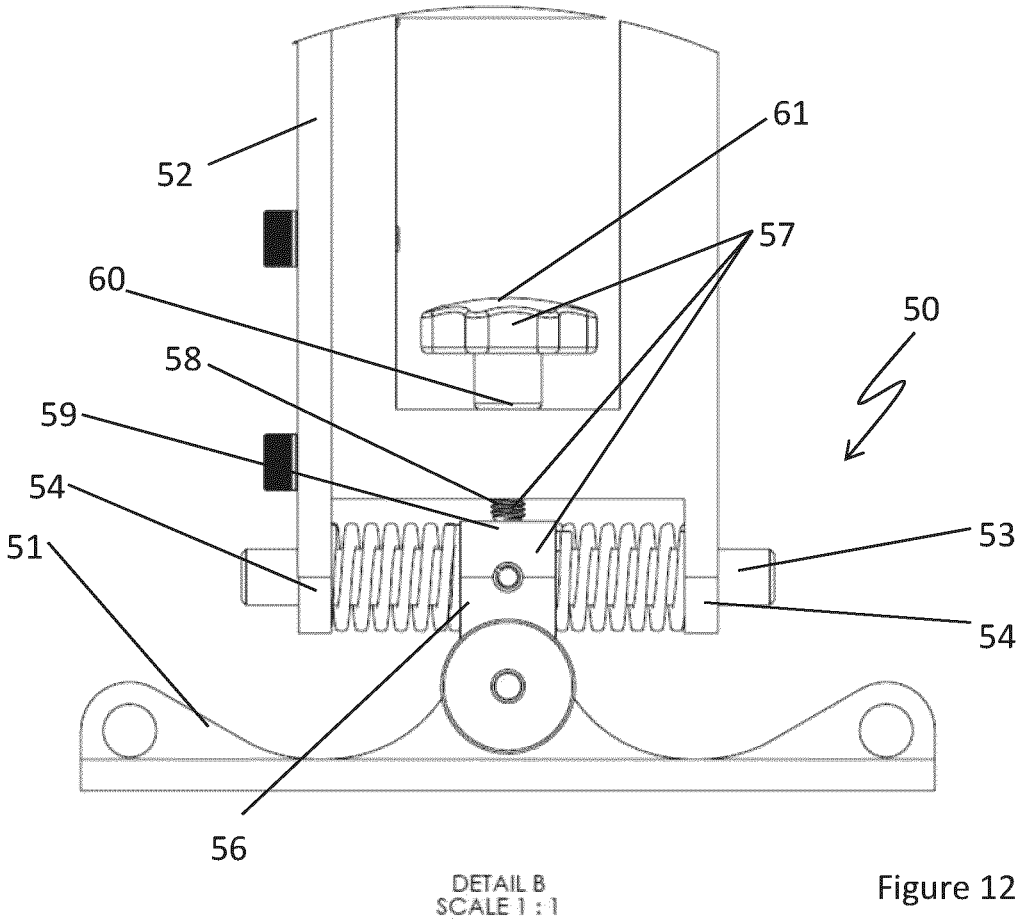
FIG. 12 is a detail view of detail B of FIG. 8.
Figure 13:
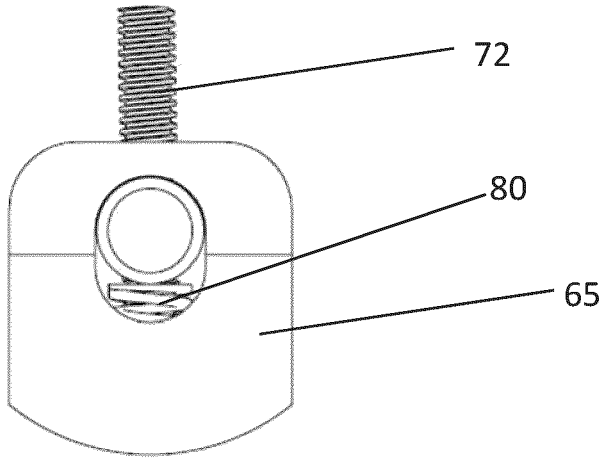
FIG. 13 is a detail view of detail C of FIG. 8.
Figure 14:
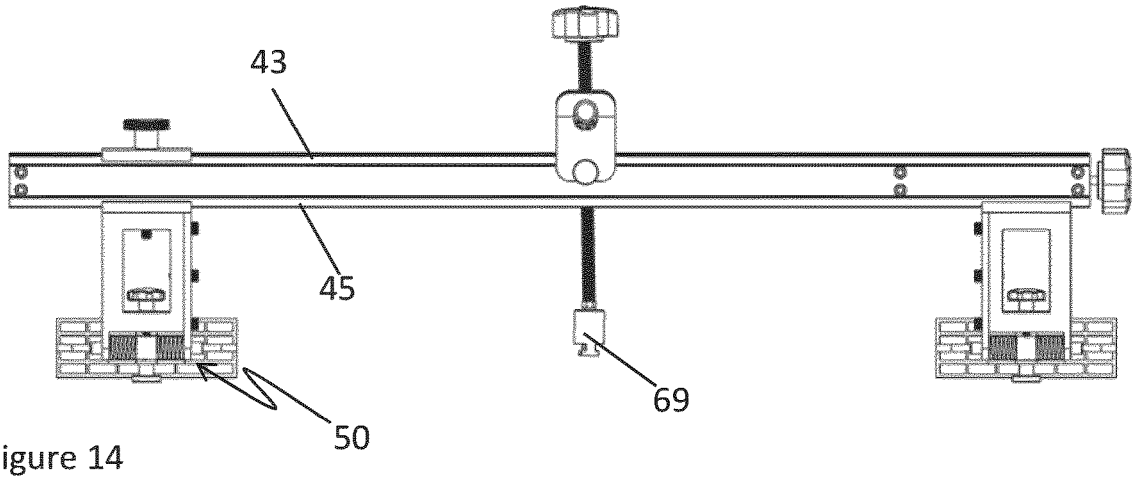
FIG. 14 is a FIG. 8 is a top view of the repair tool of FIG. 1 showing a spanning member thereof rotated out of the spanning position to a position wherein a repair site is more readily accessible.
Figure 15:
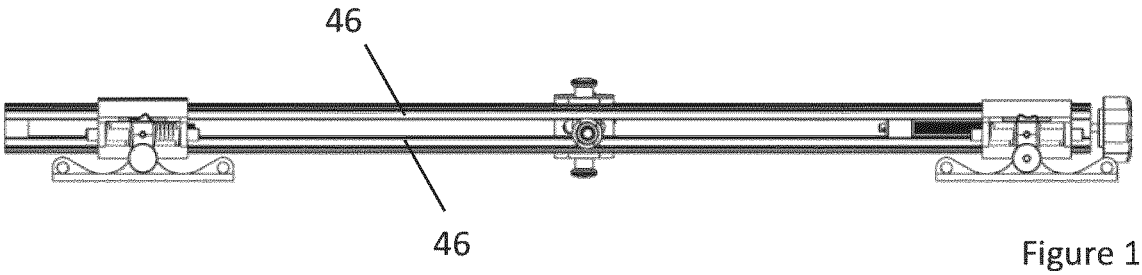
FIG. 15 is a FIG. 8 is a left side view of FIG. 14.
Figure 16:
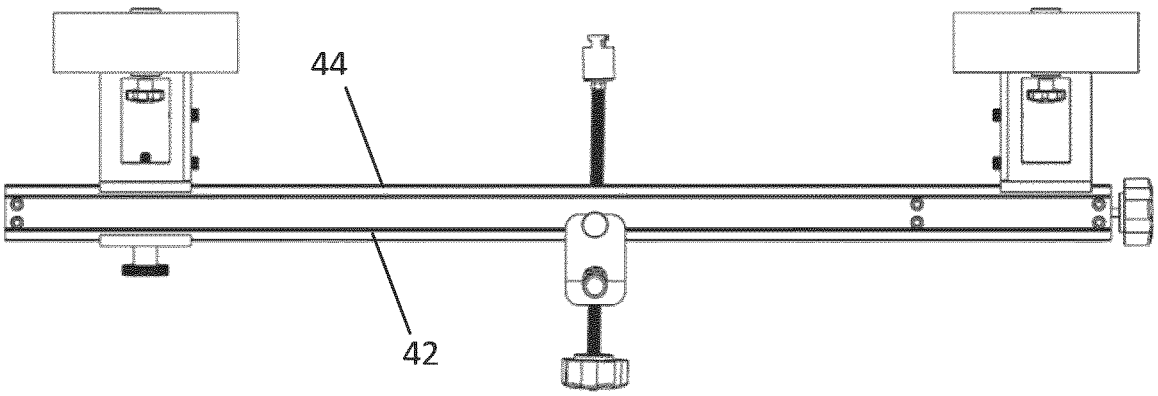
FIG. 16 is a bottom view of FIG. 14.
Figure 17:
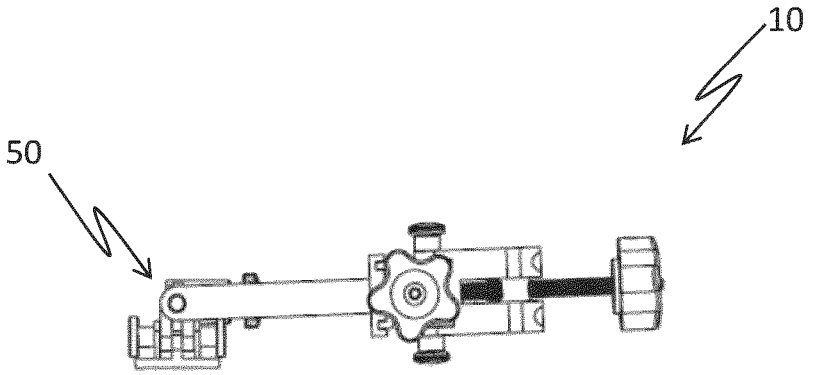
FIG. 17 is an end view of FIG. 14.

A movable connection arrangement 50 is provided which permits relative movement between the spanning member 15 and at least a portion of the support elements 11, 12. In the embodiment of the drawings the movable connection arrangement 50 is two hinged arrangements 50 such that the spanning member 15 can be rotated laterally to either side of the support elements 11, 12 and the area between the support elements 11, 12 is more readily accessible. This is best viewed in FIGS. 14 to 17, which shows the spanning member 15 rotated to first and second sides of the support elements 11, 12. In the preferred embodiment, each of the support members 11, 12 comprises a hinged arrangement 50, preferably proximal the first ends 13 thereof. The hinged arrangements 50 can be best viewed in FIG. 12 and create a hinged joint between two portions 51, 52 of the support elements 11, 12. In the embodiment of the drawings the first portion of the support elements 11, 12 is the foot 17 thereof, the second portion 52 being the remainder of the respective support element 11, 12. However, it should be understood that the hinged arrangement could be placed at another location of the support elements 11, 12. The hinge arrangements 50 are locatable proximal the foot 17 of each support element 11, 12 such that the portion 52 of each support element 11, 12 above the hinge arrangements 50 is rotatable relative to the foot 17 of the support elements 11, 12. The hinged arrangements 50 are configured to permit the portions 52 of the support elements 11, 12 above said hinged arrangements 50 to rotate approximately 90 degrees in each direction, said direction being the lateral relative to the orientation of the spanning member 15. This can be viewed in FIG. 17. It should be understood that the figure of 90 degrees is not intended to be limiting, the rotation can be to any degree which increases access to the material between the support elements 11, 12. The hinged arrangements 50 are configured to permit the portions 52 of the support elements 11, 12 above said hinged arrangements 50 to rotate towards the material to be repaired to which the support elements 11, 12 are attached during use. The hinged arrangements 50, in the embodiment of the drawings, comprise a hinge pin 53 which is rotatable within two lugs 54 formed on the bottom of the second portion 52 of the support elements 11, 12. The lugs 54 comprise bores formed therein (not shown) to receive said hinge pin 53, and the foot 17 of the support elements 11, 12 comprise a pin receiving section 56 locatable between the two lugs 54 such that the hinge pin passes through the bores formed in the lugs 54 and a bore (not shown) formed in the pin receiving section 56 to form a hinged joint between the foot 17 and the remainder of the support elements 11, 12. A spring 55 is provided which is tensioned to provide a residual tension on the hinged arrangement. Whilst one implementation of a hinged arrangement is shown and described it should be understood that rotational or hinged movement may be implemented in any number of ways which would be evident to the skilled person. For example, other hinged arrangements or other assemblies such as ball and socket assemblies could be utilised.

Each hinged arrangement 50 further comprises a locking assembly 57 for releasably locking the hinged arrangements 50. The locking assemblies 57 prevent rotation of said hinge arrangements 50 such that the spanning member 15 can be locked in the spanning position or in a rotated position wherein the spanning member 15 is rotated about the hinged arrangements 50 to provide increased access to the portion of material to be worked on between the support elements. The spanning member 15 may be locked in any rotated position between the spanning position and a position approximately 90 degrees therefrom in each lateral direction (this position being that shown in FIG. 17). The locking assemblies 57 comprise a threaded locking element 58, the first end of which passes through an aperture in the second portion 52 of the support elements 11, 12 and into a threaded receiving element 59 in the foot 17 of the support elements. The threaded receiving elements 59 comprise a complementary thread to that of the threaded locking element. A clamping surface 60 located on the underside of a locking knob 61, the locking knob being attached to the second end of the threaded locking element. As the locking knob is rotated it rotates the threaded locking element 58 and threads it into the threaded receiving element 59 drawing the locking knob 61 towards the threaded locking element 59 and bringing the clamping surface into contact with the second portion 52 of the support element such that a clamping force is applied to the second portion 52 of the support element between the clamping surface 60 and the threaded receiving element 59. Thus, the clamping surface 60 applies a clamping force as the threaded locking element 58 is threaded into the receiving element 59. It should be understood that, in the embodiment of the drawings, both support elements 11, 12 comprise locking arrangements 57, however in some embodiments only one of the support elements 11, 12 may comprise a locking element. Whilst one implementation of a locking arrangement is shown and described it should be understood that a clamping or locking assembly to selectively prevent movement of a hinged joint may be implemented in any number of ways which would be evident to the skilled person. As such the specific implementation as shown in the embodiments of the drawings is not intended to be limiting in any way.

Figure 18:
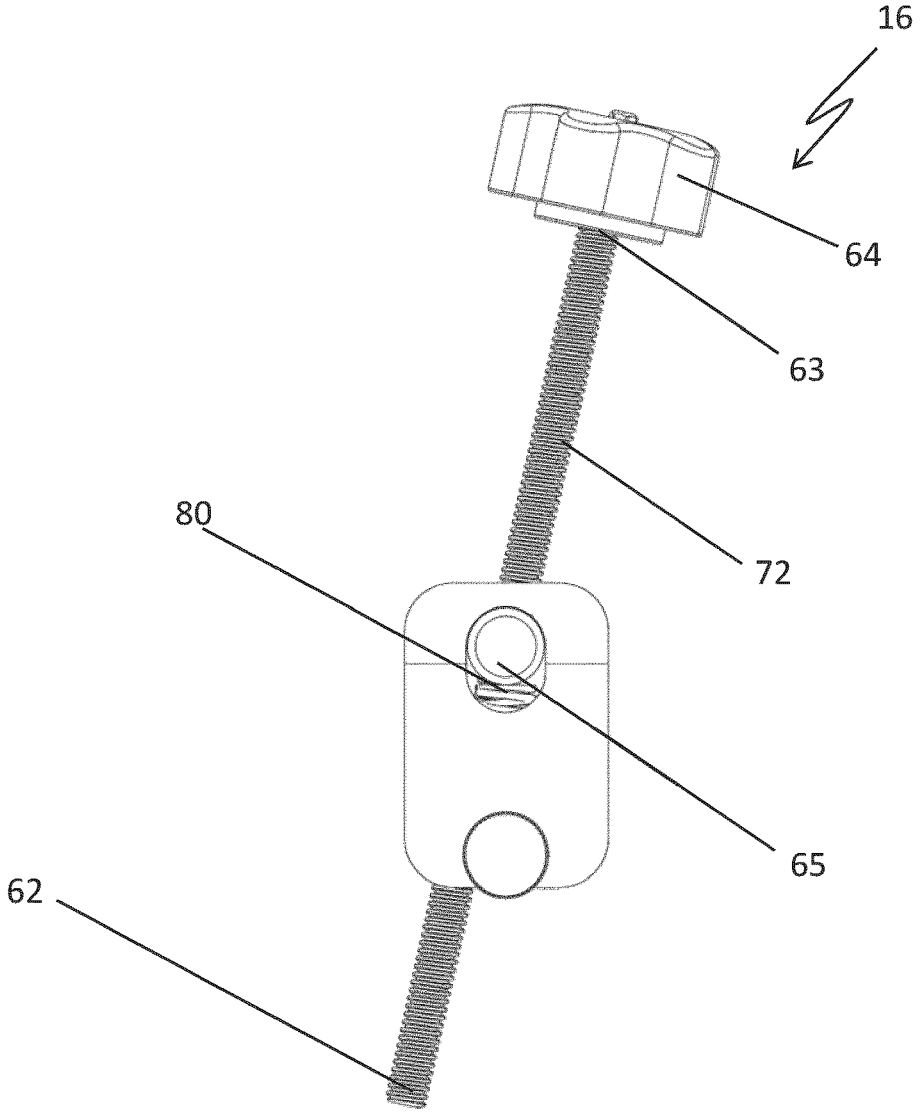
FIG. 18 is a side view of a pull/push assembly of the repair tool of FIG. 1.
Figure 19:
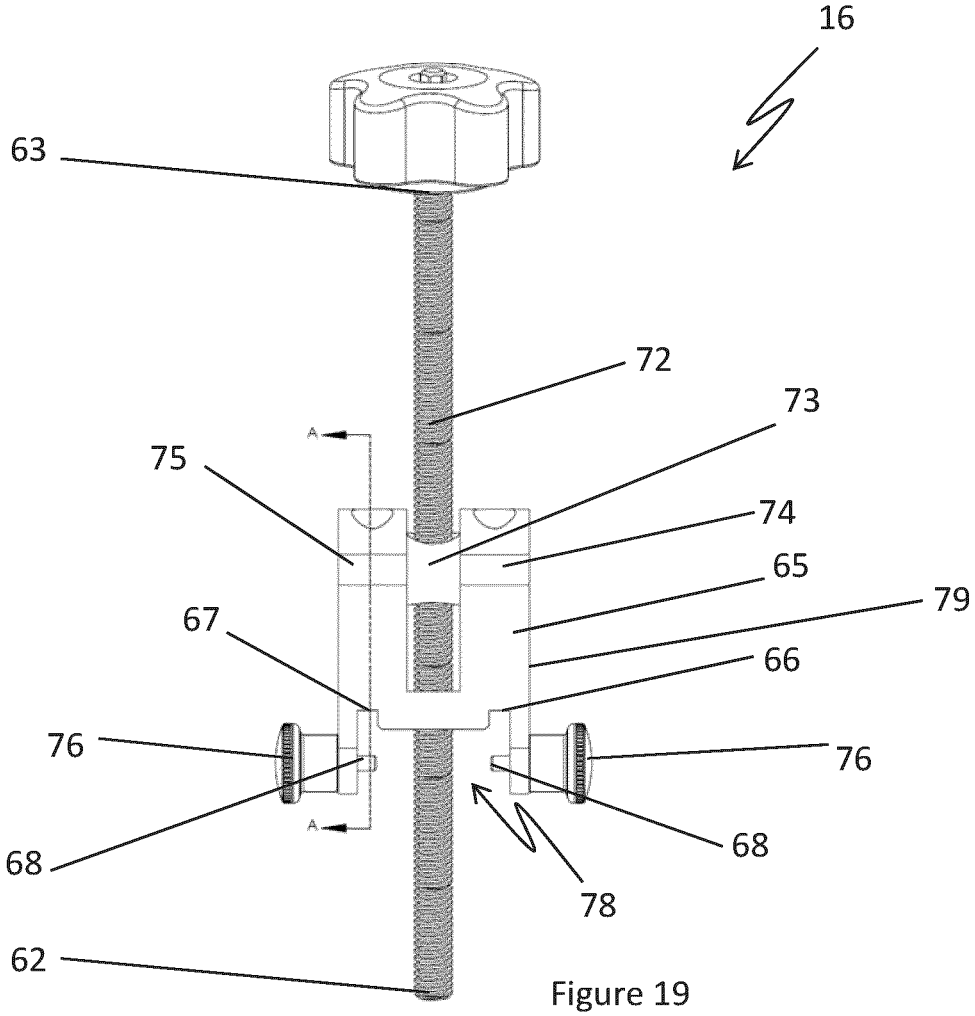
FIG. 19 is a front view of the pull/push assembly of FIG. 18.
Figure 20:
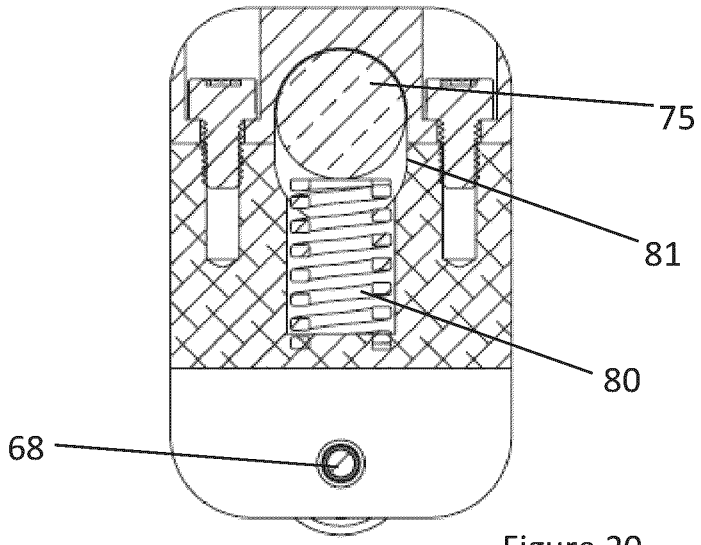
FIG. 20 is a cross sectional view of section AA of FIG. 19.

Preferably, as can be best viewed in FIGS. 18 to 20, the pull/push arrangement 16 comprises a pull/push assembly 16 having a first end 62 releasably attachable to the material to be repaired. The first end 62 may have further attachment aids or components 69 that may be interchangeable and aid in attachment of the first end 62 to the material that is to be repaired. The pull/push assembly 16 comprises a second end 63 distal the first end comprising a pull knob 64 operable by a user to cause a pulling force upon said material. The pull/push assembly further comprises a pull/push carriage 65 configured for operable engagement with the spanning member 15 such that the pull/push carriage 65 is movable longitudinally along the spanning member 15. To this end, the pull/push carriage comprises two channels 66, 67 formed in the spanning member facing side thereof for receiving the upwardly depending flanges 42, 43 of the spanning member 15 such that movement of the pull/push carriage 65 along the spanning member 15 is guided by said one or more upwardly depending flanges 42, 43. The pull/push carriage has a protrusion feature 68 which interacts with carriage rail features 70, 71 of the spanning member 15 to guide longitudinal movement along the spanning member 15 and prevent vertical displacement of the pull/push carriage 65 from the spanning member 15. The carriage rail feature comprises two rail flanges 70, 71 which project laterally outwardly of the spanning member 15 and the protrusion feature 68 of the pull/push carriage abuts the underside of the rail flanges 70, 71. The protrusion features 68 may also be adjustable and comprise adjustment knobs 76 which when turned cause the protrusion features 68 to extend towards and into contact with the outer surface 77 of the outer walls 40, 41 of the spanning member 15. The adjustable protrusion features 68 may comprise a threaded shaft (not shown) which extends through threaded throughbores formed in the pull/push carriage 65, the threaded shafts having the adjustment knobs 76 attachable at a first end on the external facing sides of the pull/push carriage 79 and extend to an internal cavity portion 78 of the pull/push carriage 65 wherein they may come in contact with the spanning member 15. Turning of the adjustment knobs 76 effects threading of the threaded shafts within the threaded throughbores in the pull/push carriage 65 and resultantly movement of the protrusion features 68 towards or away from the spanning member 15 depending on the direction of threading. Advantageously, the adjustable protrusion features 68 may be utilised to move the protraction features 68 towards the spanning member 15 and into contact therewith, applying a clamping force which releasably secures the pull/push carriage 65 to the spanning member such that the position of the pull/push carriage 65 may be locked if desired. The rail flanges 70, 71 extend longitudinally along the spanning member 15 at or about each top longitudinal edge of the spanning member 15 and the upwardly depending flanges 42, 43 of the spanning member 15 extend from an upper surface of the rail flanges 70, 71, the upper surface being that opposing the surface thereof which abuts the protrusion feature 68. The pull/push assembly 16 comprises a threaded pull/push member 72 having a first end 62 forming the first end of the pull/push assembly 16 and being configured for attachment to material to be repaired as noted above, and a second end distal the first end, the second end 63 having the pull knob 64 attached thereto. A thread receiving portion 73 is attachable to the pull/push carriage 65 and the threaded pull/push member 72 extends from its first end 62 beneath the spanning member, through the thread receiving portion 73 in the pull/push carriage, and to its second end 63 above the spanning member 15. The threaded pull/push member 72 is threaded through the threaded receiving portion 73 of the pull/push assembly, said threaded receiving portion 73 having a thread which is complementary to the thread of the threaded pull/push member 72. Threading of the threaded pull/push member 72 into the thread receiving portion 73 causes movement of the threaded pull/push member 72 relative to the pull/push carriage 65 and spanning member 15. Threading/rotation of the threaded pull/push member 72 in a first direction causes the threaded pull/push member 72 to move generally upwards such that the first end 62 thereof moves away from the material to be repaired and towards the spanning member 15. Advantageously, threading of the pull/push member 72 may apply a pulling force to material which may be attached to the first end 62 of the pull/push assembly 16. Rotation of the threaded pull/push member 72 in a second direction opposing the first direction causes the threaded pull/push member to move generally downwards such that the first end 62 thereof moves away from the spanning member 15. In the embodiment shown in the drawings, the threaded receiving portion 73 of the pull/push assembly 16 is rotatably attachable to the pull/push carriage 65 by a pivotable coupling comprising two pivot pins 74, 75 which extend through throughbores 81 formed in the pull/push carriage 65 and into receiving bores formed in the threaded receiving portion 73 of the pull/push assembly 16. This allows for free rotation of the threaded pull/push member 72 and threaded receiving portion 73 relative to the pull/push carriage 65 and enables any pulling force applied by the pulling assembly 16 to be applied in the intended direction. Advantageously, as the pull/push member 72 is rotatable about the pivot pins 74, 75, the force applied to the material to be repaired by the pull/push assembly 16 may not necessarily be a perpendicular to the surface thereof, or a straight upwards force, but rather may be applied at an oblique angle relative to the surface of the material to be repaired as required. This oblique angle is dictated by the positioning of the pull/push carriage 65 on the spanning member 15. For example should the pull/push carriage be located directly above the defect to be repaired the force applied by the pull/push assembly 16 would be perpendicular to the surface of the material to be repaired, or generally straight upwards from the defect. However, should the pull/push carriage 65 be positioned on the spanning member at a location offset from directly above the defect to be repaired, the pull/push member 72 will rotate about the pivot pins 74, 75 such that the force applied to the defect is at an oblique angle, the pull/push member 72 extending at this oblique angle between its first end which is engaged with the defect and its second end proximal the pull/push carriage 65. Again, as mentioned before herein, the description of the pull/push carriage and its function are generally referred to in terms of its capability to apply a pulling force, however as stated it is equally capable of applying a pushing force. Therefore the preceding description of applying a non-perpendicular or oblique angled pulling force may be equally applied to the application of a pulling force at such an angle, simply by reversing the direction in which the pull/push member 72 is moved (towards or away from the material to be repaired) in order to apply the desired force. The throughbores 81 in the pull/push carriage 65 which are formed for receiving the pivot pins 74, 75 are elongated throughbores 81 such that when said pivot pins 74, 75 are received therein they may move to a limited extent vertically as well as being rotatable within said throughbores 81, this is best seen in FIG. 20. Springs 80 are provided which are biased to provide a residual tension on the pivot pins 74, 75 such that said pivot pins 74, 75 are urged upwards towards the second end of the pull/push assembly 16 by said springs 80. It should also be noted that whilst the term pull/push arrangement and pull/push assembly are utilised, the same feature may also be utilised to apply a pushing force on the material to be repaired by simply reversing the direction such that the first end 62 of the pull/push arrangement is moved into contact with and further into the material to be repaired. As such the pull/push arrangement 16 would be construed by the skilled person as an arrangement capable of applying a pulling force or a pushing force on the material to be repaired. As such, it should be understood that any reference to pulling forces applied by the pulling arrangement herein could equally be pushing forces applied thereby should the user find application of a pushing force useful for a particular repair or portion thereof. The pull/push arrangement 16 provides a preloaded force perpendicular to the working surface of the material to be repaired. The preloaded force is applied to the pulling arrangement to provide a semi-constant perpendicular force over a greater displacement distance as the damaged material area pulls out. Whilst one implementation of a movable pull/push assembly is shown and described it should be understood that various elements of the pull/push assembly be implemented in any number of ways which would be evident to the skilled person. As such the specific implementation as shown in the embodiments of the drawings is not intended to be limiting in any way and the scope of protection should be considered to encompass any assembly that my be utilised to attach to the spanning member and apply a pulling or pushing force to material to be repaired thereunder. For example, a pneumatic or hydraulic arrangement could be utilised to effect the pulling or pushing force. In addition, whilst only one pull/push arrangement is shown in the embodiment of the drawings, further pull/push arrangements may be provided to provide further pulling or pushing forces to the material to be repaired. In general herein, the movement of various components of the tool are generally manually effected by turning of knobs etc, however it should be understood that these movements could be effected by electronic means, optionally in conjunction with a pneumatic or hydraulic arrangement, such that a user may move the support elements relative to each other, move the pulling arrangement to effect a pull or push force, and rotate the spanning member 15 to improve access by operating switches, a computer, or any other such suitable user interface.

Figure 22:
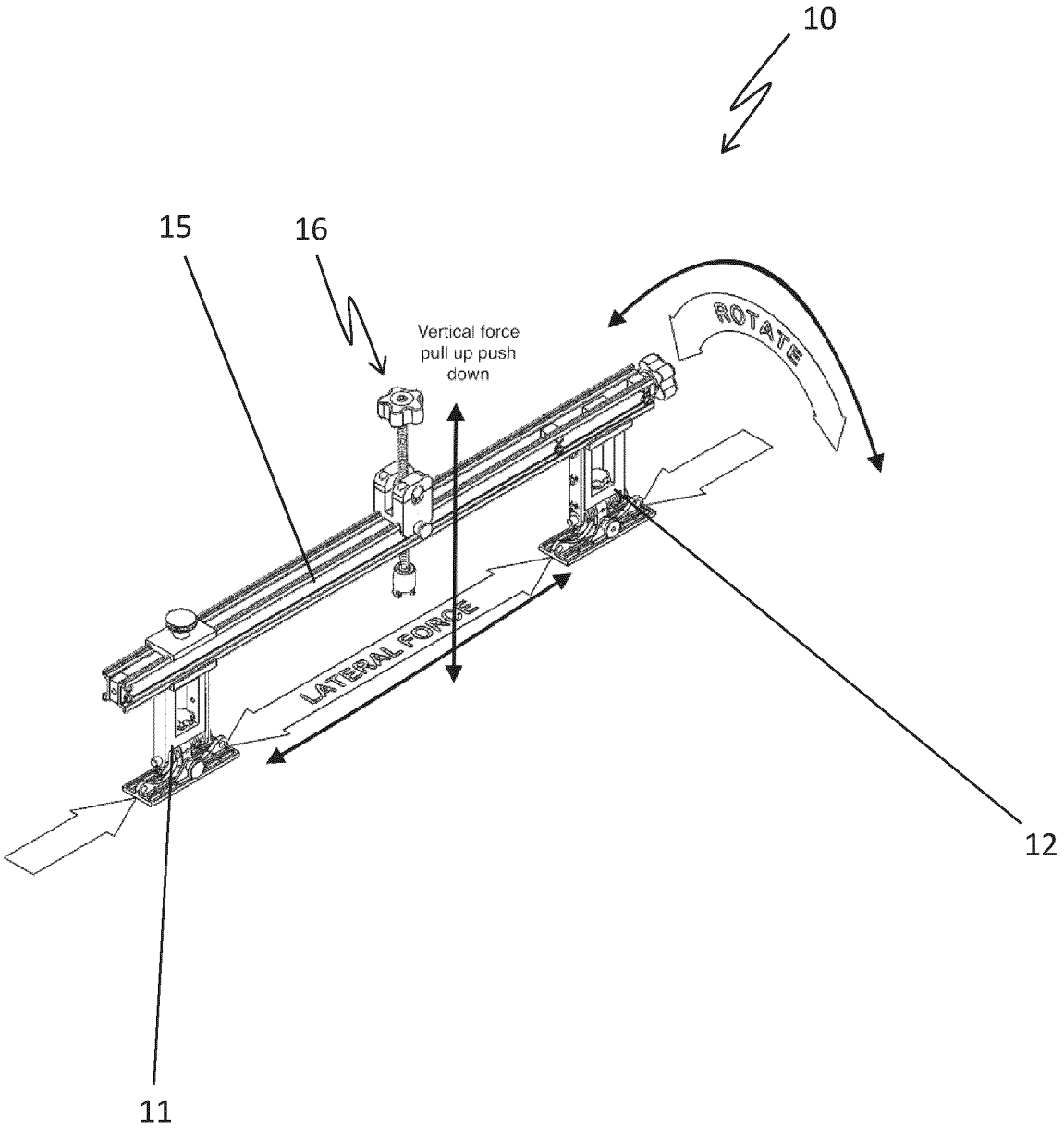
FIG. 22 is an isometric view of the repair tool of FIG. 1 showing the forces that may be applied thereby to a material.

FIG. 22 shows the forces applied and movements possible in relation to a most preferred embodiment of the invention which comprises both the movable spanning member 15 and the pull/push arrangement 16 additional features such that three unique features and associated technical advantages are provided in a single tool 10. Namely, this single tool 10 can apply a tension or a compression force to the material between the support elements 11, 12, also apply a pulling or pushing force via the pull/push arrangement, and can maintain the tension or compression force whilst the spanning member 16 is rotated to improve access to the repair site.

The invention is not limited to the embodiment(s) described herein but can be amended or modified without departing from the scope of the present invention.

The invention claimed is:

1. A repair tool comprising:

at least first and second support elements, the first and second support elements each comprising a first end which is adhesively bonded or welded to a portion of material to be repaired and a second end distal the first end;

a spanning member engagable with the support elements, the spanning member being sized and dimensioned to span between said support elements in a spanning position above a portion of material to be repaired;

wherein in the spanning position, the spanning member, supported by the support elements, forms an elevated bridge above the site of repair and one or both of the support elements are movable relative to the spanning member in the longitudinal direction thereof after the support elements are adhesively bonded or welded to the material to be repaired to adjust the distance between the first and second support elements such that, in use, when the first and second support elements are adhesively bonded or welded to a portion of material to be repaired, a lateral tension or compression is selectively applied or released from said material by movement of one or both of the support elements towards or away from each other after the support elements are adhesively bonded or welded to the material to be repaired; and wherein the repair tool further comprises a pull/push arrangement mountable to the spanning member between the first and second support elements configured to apply a pulling or a pushing force to a portion of the material to be repaired; and wherein movable connection arrangements are provided between the spanning member and at least a portion of each support element such that the spanning member is rotatable laterally relative to at least a portion of the support elements, lateral being relative to the orientation of the spanning member, and to either side of the support elements, such that the area between the support elements is more readily accessible.

2. The repair tool of claim 1, wherein the support elements comprise spanning member engagement means at the second end thereof, the spanning member engagement means of at least one of the first or second support member being a movable engagement means for selectively effecting or permitting longitudinal movement of the support element relative to the spanning member.

3. The repair tool of claim 2, wherein both the first and second support elements comprise movable engagement means for selectively effecting or permitting movement of the support element relative to the spanning member.

4. The repair tool of claim 3, wherein the movable engagement means of the first support element comprises a releasable engagement means such that the releasable engagement means is released to allow free longitudinal movement of the first support element along the spanning member and is engaged to releasably fix the first support element to the spanning member at a desired position.

5. The repair tool of claim 4, wherein the releasable engagement means of the first support element comprises first and second clamping surfaces which act to clamp the spanning member therebetween, the first clamping surface being provided by a clamping feature locatable on the opposing side of the spanning member from the first support element and the second clamping surface being provided by spanning member facing surface of the first support element.

6. The repair tool of claim 5, wherein the first and second clamping surfaces are in operable engagement via a clamping actuation means such that said clamping surfaces are movable towards each other to clamp the spanning member therebetween and prevent movement of the first support member therealong, and moveable away from each other such that the first support element is freely movable along the spanning member.

7. The repair tool of claim 6 wherein the clamping actuation means comprises a threaded clamping rod having a first end which extends through an aperture in the clamping feature, through the spanning member, and into a correspondingly threaded clamping rod receiving portion in the first support element, the threaded clamping rod having a clamping head located at its second end distal the first end thereof which is engagable with the clamping feature as the threaded clamping rod is threaded into the clamping rod receiving feature to apply a clamping force to the spanning member between the clamping feature and the first support element.

8. The repair tool of claim 3, wherein the movable engagement means of the second support element comprises an adjustable engagement means wherein a user engagable control element is operable to effect relative longitudinal movement between the spanning member and the second support element.

9. The repair tool of claim 8, wherein the adjustable engagement means is a screw and thread type arrangement operable between the spanning member and second support element.

10. The repair tool of claim 9, wherein the screw and thread type arrangement comprises a second support element threaded rod which extends in the longitudinal direction of the spanning member, the second support element threaded rod being mountable to the spanning member by first and second bushes which permit rotation of the threaded rod but prevent any non-rotational movement of the threaded rod relative to the spanning member.

11. The repair tool of claim 10, wherein the spanning member facing end of the second support element comprises a threaded rod receiving structure fixedly attachable thereto, the second support element threaded rod being threadable through the threaded rod receiving structure and rotatable therewithin such that as the second support element threaded rod is rotated within the bushes, the threaded rod receiving structure travels along the second support element threaded rod causing a corresponding movement of the second support element in the longitudinal direction of the spanning member.

12. The repair tool of claim 1, wherein the spanning member is an elongate channel member comprising first and second outer walls defining an internal void and one or more engagement features formed for engagement with the support elements and/or the pull/push arrangement.

13. The repair tool of claim 12, wherein the engagement features of the spanning member comprise one or more upwardly depending flange extending from an upper side of the spanning member opposing the side in engagement with the support elements, and/or one or more downwardly depending flange extending from a lower side of the spanning member in engagement with the support elements, and/or one or more inwardly depending flanges which extend from the first and second outer walls of the spanning member into the void thereof.

14. The repair tool of claim 12, wherein the spanning member comprises first and second elongate channel sections joined in a spaced apart relationship by spacing elements to define the void therebetween.

15. The repair tool of claim 1, wherein the movable connection arrangement is one or more hinged or other such rotatable arrangements such that the spanning member can be rotated laterally and the area between the support elements is more readily accessible.

16. The repair tool of claim 15, wherein each of the support members comprises a hinged arrangement, proximal the first end thereof, said hinged arrangement creating a movable joint between two portions of the support elements.

17. The repair tool of claim 15, wherein the movable connection arrangement comprises one or more locking assembly for releasably locking the movable connection arrangement such that locking of the one or more locking assembly prevents relative movement between the spanning member and at least a portion of the support elements about the movable connection arrangement, and release of the one or more locking assembly permits said relative movement.

18. The repair tool of claim 17, wherein each support element comprises a locking assembly and the locking assemblies comprises a threaded locking element, the first end of which passes through an aperture in a second portion of a support element and into a threaded receiving element in a first portion of a support element, the threaded locking element having a clamping surface provided on the second end thereof which interacts with a surface of the first portion of the support elements and applies a clamping force thereto, forcing the first and second portions of the support elements together as the threaded locking element is threaded into the threaded receiving element.

19. The repair tool of claim 1 wherein the pull/push arrangement comprises a pull/push assembly having a first end, which is releasably attachable to the material to be repaired, and a second end operable by a user to cause a pulling or pushing force upon said material.

* * * * *